US006279202B1

(12) United States Patent
Wojdylak et al.

(10) Patent No.: US 6,279,202 B1
(45) Date of Patent: Aug. 28, 2001

(54) LAPEL PIN

(75) Inventors: George Wojdylak; Mark D. Wojdylak, both of Fresno, CA (US)

(73) Assignee: B.A.C. & Associates, Inc., Fresno, CA (US)

( * ) Notice: Subject to any disclaimer, the term of this patent is extended or adjusted under 35 U.S.C. 154(b) by 0 days.

(21) Appl. No.: 09/396,791

(22) Filed: Sep. 15, 1999

(51) Int. Cl.[7] ..... A44C 3/00
(52) U.S. Cl. ..... 24/12; 24/13; 24/60; 40/1.5
(58) Field of Search ..... 24/12, 13, 6, 60, 24/63, 716; 40/1.5, 641

(56) References Cited

U.S. PATENT DOCUMENTS 269,056 * 12/1882 Hilliard ..... 24/12
317,650 * 5/1885 Jones ..... 24/6
539,137 * 5/1895 Knubel ..... 24/63
613,029 * 10/1898 Fair ..... 24/13
1,678,810 * 7/1928 Fulper ..... 24/6
3,088,295 * 5/1963 Haines ..... 24/13
3,444,595 * 5/1969 Wachenheimer ..... 24/716
5,191,682 * 3/1993 Davis-Reardon et al. ..... 24/13
5,210,966 * 5/1993 Fuehrer ..... 40/1.5
5,457,852 * 10/1995 Liu ..... 24/13

FOREIGN PATENT DOCUMENTS

8704906 * 8/1987 (WO) ..... 24/13

* cited by examiner

*Primary Examiner*—Victor N. Sakran
(74) *Attorney, Agent, or Firm*—Law Office of William L. Klima, P.C.

(57) ABSTRACT

A lapel pin is provided including a display portion and a post portion moveably connected to said display portion. Preferably, the post portion is hingedly moveably disposed relative to the display portion and the display portion preferably includes a recessed portion for receiving the post portion when the lapel pin is not in use.

17 Claims, 2 Drawing Sheets

LAPEL PIN

FIELD OF THE INVENTION

The present invention is related to lapel pins.

BACKGROUND OF THE INVENTION

The typical lapel pin includes a display portion having a post portion extending perpendicularly from a flat rear surface thereof. The typical lapel pin further includes a clasp portion which receives and releasably retains the post portion. In use, the post portion is passed through a lapel and the clasp portion is then secured to the post portion to mount the lapel pin to the lapel.

Lapel pins are often used by persons to express an affiliation with or support for a particular cause. Lapel pins are often shipped individually to such persons. Shipping individual lapel pins presents a number of problems. For example, the post portion of the lapel pin easily penetrates through packaging materials. As a consequence, persons handling the packaging in which the lapel pin is sent are subjected to a puncture wound from the exposed post portion of the lapel pin.

SUMMARY OF THE INVENTION

It is a first object of the present invention to provide a lapel pin.

It is a second object of the present invention to provide an improved lapel pin.

It is a third object of the present invention to provide a lapel pin which is easily shipped.

It is a fourth object of the present invention to provide a lapel pin which is safe to use.

It is a fifth object of the present invention to provided a lapel pin which is cost effective to manufacture.

The present invention provides a lapel pin having a display portion and a post portion which is moveably connected to the display portion. A clasp configured to removably retain at least a portion of the post portion is preferably provided for securing the lapel pin to a lapel. Preferably, the post portion is hingedly connected to the display portion and the display portion further preferably includes a recessed portion for receiving the post portion.

The post portion of the preferred embodiment is preferably maintained within the recessed portion of the display portion when the lapel pin is not in use. When the post portion is within the recessed portion, the lapel pin is easily placed into a standard envelope for shipping. Moreover, since the post portion is not exposed the lapel pin is rendered much safer.

DETAILED DESCRIPTION OF PREFERRED EMBODIMENTS

Figure 1:
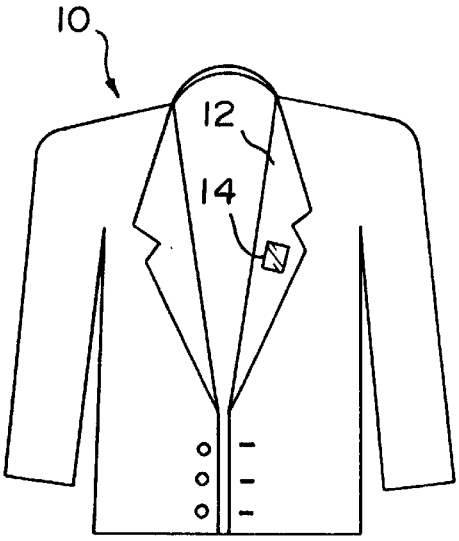
FIG. 1 shows a front view of a lapel pin mounted to a lapel of a jacket according to the present invention.
Figure 2:
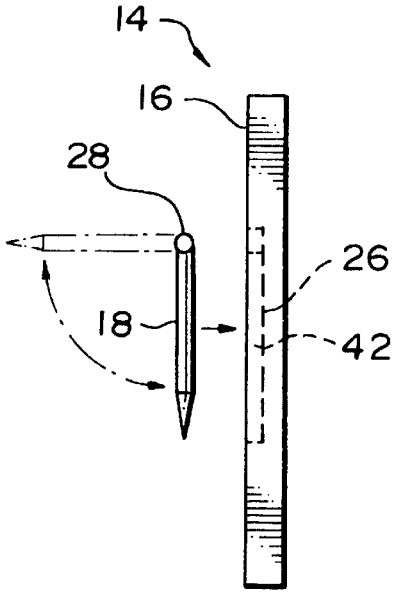
FIG. 2 shows a side view of a preferred embodiment of a lapel pin according to the present invention.
Figure 3:
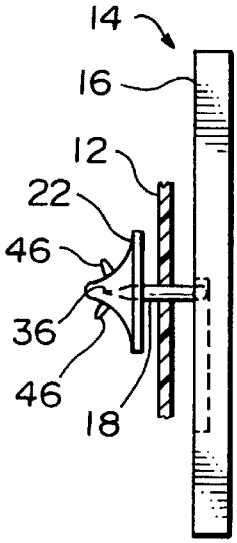
FIG. 3 shows a partial cross-sectional side view of a lapel pin mounted to a lapel according to the present invention.

FIGS. 1–6 show a preferred embodiment of a lapel pin 14 according to the present invention. As shown in FIGS. 1–3, lapel pin 14 is preferably mounted to a lapel 12 of a jacket 10. However, a lapel pin 14 according to the present invention may be mounted to any material.

Lapel pin 14 preferably includes a display portion 16 and a single post portion 18 moveably connected to display portion 16 as shown in FIG. 2. As shown in FIG. 2, post portion 18 is preferably moveably connected to display portion 16 in a hinged manner. However, the present invention contemplates that post portion 18 may be, for example, slidably moveably connected to display portion 16. As another example, post portion 18 may be retractably moveably connected to display portion 16. As still another example, post portion 18 may be pivotally moveably connected to display portion 16.

Figure 5:
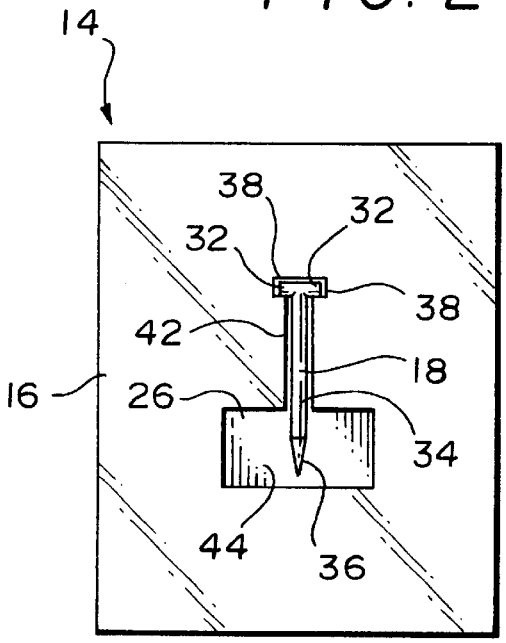
FIG. 5 shows a rear view of the lapel pin shown in FIG. 2.

Preferably, post portion 18 includes an elongated portion 34 and a pointed portion 36. In the preferred embodiment of lapel pin 14 shown in FIGS. 1–6, post portion 18 further includes a pair of trunnions 32 extending perpendicularly from an end 28 of elongated portion 34 as shown in FIG. 5. Trunnions 32 are received in bearings 38 in display portion 16 as shown in FIG. 5. Trunnions 32 and bearings 38 cooperate to allow a user to hingedly move post portion 18 relative to display portion 16 as shown in FIG. 2.

Figure 6:
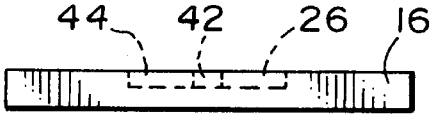
FIG. 6 shows an end view of the lapel pin shown in FIG. 2.

As shown in FIGS. 2–6, display portion 16 preferably further includes a recessed portion 26. Recessed portion 26 preferably defines bearings 38, a channel portion 42 for receiving elongated portion 34 of post portion 18 and an enlarged gripping area portion 44 for allowing a user to easily access post portion 18 for hinged movement thereof relative to display portion 16, as shown in FIGS. 2, 5, and 6.

In a preferred method of using the present invention, lapel pin 14 is provided to a user with post portion 16 substantially parallel to a longitudinal axis of display portion 16. In other words, lapel pin 14 is preferably provided to a user with pointed portion 36 of post portion 18 within recessed portion 26. It is important to note that when pointed portion 36 of post portion 18 is within recessed portion 26, lapel pin 14 may be easily enclosed in a standard envelope. Thus, the present invention provides a lapel pin 14 which is more easily delivered to an end user, for example, as part of a promotional campaign. Further, the present invention provides a lapel pin which is relatively safe since when not in use, post portion 18 may be stored in recessed portion 26, thus removing any threat of a puncture wound, for example, from post portion 18.

Figure 4:
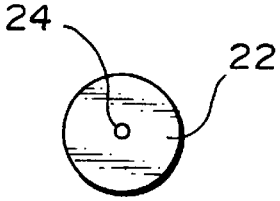
FIG. 4 shows a rear view of a clasp portion according to the present invention.

To use lapel pin 14, a user grasps and operates post portion 18 relative to display portion 16. For the embodiment shown in FIG. 2, operating post portion 18 consists of rotating post portion 18 relative to display portion 16 as shown. Then, at least a portion of post portion 18 is passed through the material of lapel 12 as shown in FIG. 3. Mounting of lapel pin 14 to lapel 12 is completed with clasp potion 22. Specifically, pointed portion 36 of post portion 18 is placed into hole 24 of clasp 22, as shown in FIGS. 3 and 4. Clasp 22 is configured to releasably lock onto post portion 18 as shown in FIG. 3. Clasp 22 includes a pair of releases 46 which are depressed to remove clasp 22 from post portion 18. Note that post portion 18 may be rotated relative to display portion 16 to return post portion 18 to recessed portion 26 for convenient storage or shipping of lapel pin 14.

Figure 7:
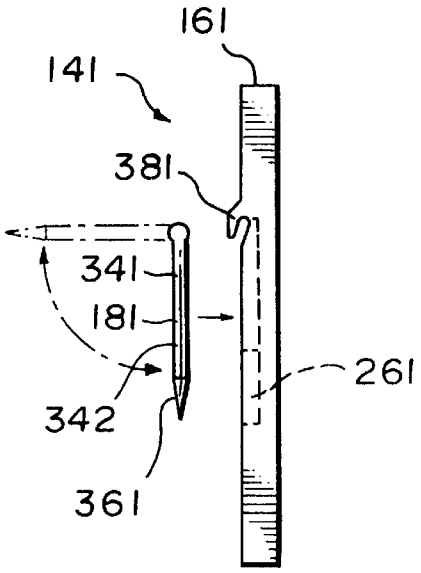
FIG. 7 shows a side view of another preferred embodiment of a lapel pin according to the present invention.
Figure 8:
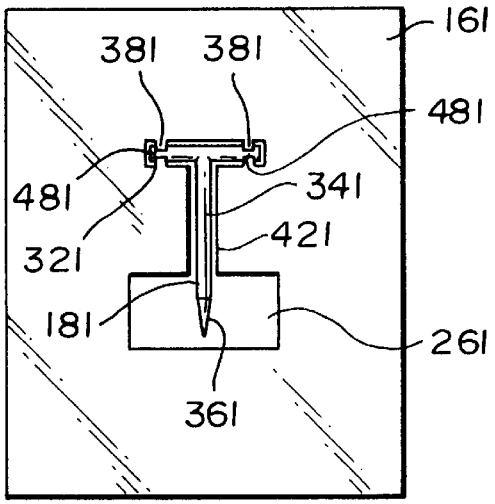
FIG. 8 shows a rear view of the lapel pin shown in FIG. 7.
Figure 9:
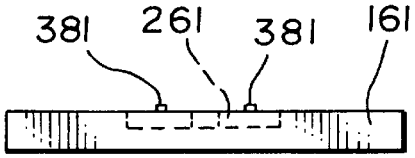
FIG. 9 shows an end view of the lapel pin shown in FIG. 7.

A second embodiment of a lapel pin 141 is shown in FIGS. 7–9. Lapel pin 141 includes integral raised bearings 381 as shown in FIG. 7. Raised bearings 381 allow elongated portion 341 of post portion 181 to remain at least partially external to recessed portion 261 when pointed portion 361 is within recessed portion 261, thus allowing a user to grasp post portion 181 without the need for contacting potentially injurious pointed portion 361. Note further from FIGS. 7–9 that trunnions 321 are provided with reduced diameter portions 481 which are received in bearings 381. Reduced diameter portions 481 prevent trunnions 321 from displacing axially relative to bearings 381, thus providing an improved movement of post portion 18.

Figure 10:
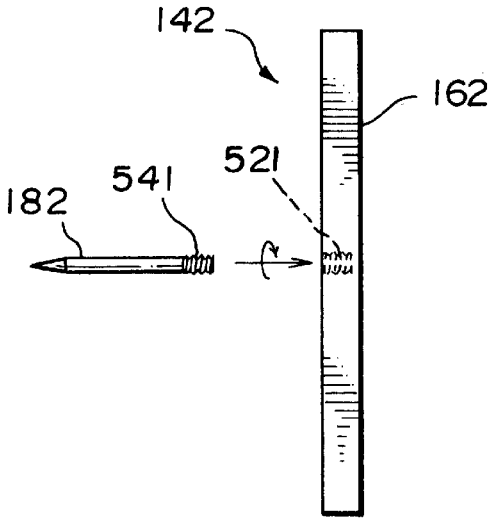
FIG. 10 shows another preferred embodiment of a lapel pin according to the present invention.
Figure 11:
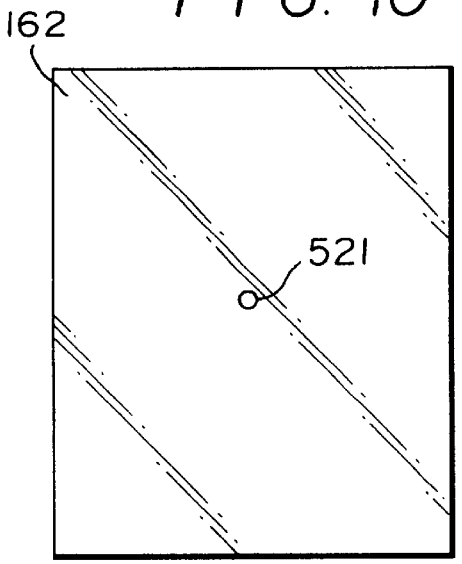
FIG. 11 shows a rear view of the lapel pin shown in FIG. 10.
Figure 12:
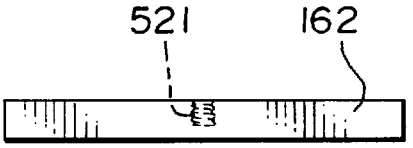
FIG. 12 shows an end view of the lapel pin shown in FIG. 10.

A third embodiment of a lapel pin 142 according to the present invention is shown in FIGS. 10–12. Lapel pin 142 includes a post portion 182 having a threaded end 541 which is receivable in threaded hole 521 in display portion 162. Thus, lapel pin 142 may be provided to a user in separate components for assembly as indicated in FIG. 10.

What is claimed is:

1. A lapel pin device, said device comprising:

a display portion including a back mounting portion;

a post portion moveably connected to said display portion, said post portion configured to be movable approximately ninety degrees (90°) from a storage position wherein said post portion is located adjacent to and aligned substantially parallel with said back mounting portion of said display portion to an operational position wherein said post portion is align substantially perpendicular with said back mounting portion; and a clasp removably connected to said post portion and configured to allow a user to connect and disconnect to an article such as clothing.

2. A device according to claim 1, wherein said post portion includes a removable clasp portion.

3. A device according to claim 1, wherein said post portion is configured to be replaceably detached from said display portion.

4. A device according to claim 1, wherein said post portion is hingedly connected to said display portion.

5. A device according to claim 1, wherein said display portion includes a recessed portion configured to receive said post portion.

6. A device according to claim 1, wherein said post portion includes an elongated portion and at least one trunnion extending perpendicularly from an end thereof, said at least one trunnion being configured to be rotatably received in at least one bearing on said display portion.

7. A device according to claim 1, wherein said post portion includes a threaded portion configured to be received by a threaded hole in said display portion.

8. A device according to claim 1, wherein said back mounting portion is configured to be aligned substantially parallel to a surface of said article to which said device is being connected thereto.

9. A device according to claim 8, wherein said display portion is a plate, and said back mounting portion of said display portion is defined by a back surface of said plate.

10. A device according to claim 9, wherein said back surface of said plate is provided with a recess for accommodating and storing said post portion.

11. A device according to claim 10, wherein said post portion and said recess located in said back surface of said plate are configured so that a tip of said post portion is unaccessible and protected.

12. A device according to claim 1, wherein said back mounting portion of said display portion is provided with a recess configured for accommodating and storing said post portion, said recess including a wider portion adjacent a tip of said post portion configured to allow a user to grip said tip and pull said post portion out of said recess and rotate said post portion from said storage position to said operational position.

13. A device according to claim 1, wherein said back mounting portion of said display portion is provided with a recess configured for accommodating and storing said post portion, said recess and said post portion configured so that said post portion is rotatably connected within said recess.

14. A device according to claim 13, wherein a connection end of said post portion is provided with a trunnion configured to be accommodated within a T-shaped portion of said recess.

15. A device according to claim 14, wherein said recess includes a wider portion adjacent a tip of said post portion configured to allow a user to grip said tip and pull said post portion out of said recess and rotate said post portion from said storage position to said operational position.

16. A method of attaching a lapel pin device to an article such as clothing, said method including the steps of:

operating a post portion moveably connected to a display portion of said device from a storage position wherein said post portion is located adjacent to and aligned substantially parallel with said back mounting portion of said display portion to an operational position wherein said post portion is align substantially perpendicular with a back mounting portion of said display portion;

passing at least a portion of said post portion through said article; and attaching a clasp portion to said post portion.

17. A method of attaching a lapel pin device to an article such as clothing, said method including the steps of:

removing a post portion and a display portion from a kit, said post portion and said display portion being configured so that said post portion is removably connectable to said display portion;

removably connecting said post portion substantially perpendicular to said display portion;

passing at least a portion of said post portion through the article, and attaching a clasp portion to said post portion.

* * * * *